US010312615B2

(12) United States Patent
Liu et al.

(10) Patent No.: US 10,312,615 B2
(45) **Date of Patent: *Jun. 4, 2019**

(54) ELECTRICAL INTERCONNECTION SYSTEM AND ELECTRICAL CONNECTORS FOR THE SAME

(71) Applicant: 3M INNOVATIVE PROPERTIES COMPANY, St. Paul, MN (US)

(72) Inventors: Deng Liu, Shanghai (CN); Xiang Yao, Shanghai (CN); Qilin Chen, Shanghai (CN)

(73) Assignee: 3M Innovation Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/164,874

(22) Filed: Oct. 19, 2018

(65) Prior Publication Data

US 2019/0052006 A1 Feb. 14, 2019

Related U.S. Application Data

(60) Continuation of application No. 15/846,282, filed on Dec. 19, 2017, now Pat. No. 10,141,667, which is a (Continued)

(51) Int. Cl.
*H01R 12/00* (2006.01)
*H01R 12/72* (2011.01)
(Continued)

(52) U.S. Cl.
CPC ..... *H01R 12/722* (2013.01); *H01R 12/585* (2013.01); *H01R 12/724* (2013.01);
(Continued)

(58) Field of Classification Search
CPC .. H01R 12/722; H01R 12/724; H01R 12/732; H01R 13/514; H01R 13/518;
(Continued)

(56) References Cited

U.S. PATENT DOCUMENTS 4,147,399 A 4/1979 Moser et al.
5,211,578 A 5/1993 Henschen et al.
(Continued)

FOREIGN PATENT DOCUMENTS

JP 2008-535184 8/2008
JP 2012-502435 1/2012
JP 2012-518266 8/2012

OTHER PUBLICATIONS

International Search Report for PCT International Application No. PCT/CN2013/072129 dated Dec. 12, 2013, 3 pages.

*Primary Examiner* — Khiem M Nguyen
(74) *Attorney, Agent, or Firm* — Robert S. Moshrefzadeh

(57) ABSTRACT

The present invention provides an electrical interconnection system comprising: a paddle card comprising a plurality of first contact pads positioned on a first surface of the paddle card and a plurality of second contact pads positioned on an opposite second surface of the paddle card; a first wafer comprising a plurality of first conductors each having a first contact portion; and a second wafer comprising a plurality of second conductors each having a second contact portion; wherein the first wafer and the second wafer are assembled together to have the first contact portion and the second contact portion face each other and be able to form a gap therebetween for accommodating at least part of the paddle card; each first contact portion is adapted to be in electrical contact with a corresponding first contact pad and each second contact portion is adapted to be in electrical contact with a corresponding second contact pad when the paddle card is at least partly accommodated in the gap.

1 Claim, 7 Drawing Sheets

Related U.S. Application Data division of application No. 15/492,258, filed on Apr. 20, 2017, now Pat. No. 9,882,299, which is a division of application No. 14/770,108, filed as application No. PCT/CN2013/072129 on Mar. 4, 2013, now Pat. No. 9,666,965.

(51) Int. Cl.

| | |
|---|---|
| ***H01R 12/58*** | (2011.01) |
| ***H01R 12/73*** | (2011.01) |
| ***H01R 13/514*** | (2006.01) |
| ***H01R 13/518*** | (2006.01) |
| ***H01R 12/79*** | (2011.01) |
| ***H01R 13/6471*** | (2011.01) |
| *H01R 13/6587* | (2011.01) |

(52) U.S. Cl.
CPC ..... *H01R 12/732* (2013.01); *H01R 12/79* (2013.01); *H01R 13/514* (2013.01); *H01R 13/518* (2013.01); *H01R 13/6471* (2013.01); *H01R 13/6587* (2013.01)

(58) Field of Classification Search
CPC .. H01R 13/6587; H01R 12/585; H01R 12/79; H01R 13/6471
USPC ..... 439/59, 78, 79, 660
See application file for complete search history.

(56) References Cited

U.S. PATENT DOCUMENTS

| | | | | |
|---|---|---|---|---|
| 6,120,332 | A | 9/2000 | Bertens | |
| 6,165,017 | A | 12/2000 | Kuo | |
| 6,390,857 | B1 | 5/2002 | Pickles et al. | |
| 6,540,522 | B2 | 4/2003 | Sipe | |
| 6,786,771 | B2 | 9/2004 | Gailus | |
| 7,473,138 | B2 | 1/2009 | Tuin et al. | |
| 7,553,190 | B2 | 6/2009 | Laurx et al. | |
| 8,657,631 | B2 | 2/2014 | Lang et al. | |
| 9,356,372 | B2 | 5/2016 | Hanna | |
| 9,461,392 | B2 | 10/2016 | Regnier et al. | |
| 9,882,299 | B2 * | 1/2018 | Liu | H01R 12/585 |
| 2004/0259420 | A1 | 12/2004 | Wu | |
| 2007/0004282 | A1 | 1/2007 | Cohen | |
| 2009/0093158 | A1 | 4/2009 | Mcalonis et al. | |
| 2009/0301761 | A1 | 12/2009 | Wu | |
| 2010/0068944 | A1 | 3/2010 | Scherer | |
| 2010/0210123 | A1 | 8/2010 | Cole et al. | |
| 2010/0291803 | A1 | 11/2010 | Kirk | |

* cited by examiner

ELECTRICAL INTERCONNECTION SYSTEM AND ELECTRICAL CONNECTORS FOR THE SAME

FIELD OF THE INVENTION

The present invention generally relates to an electrical interconnection system, and in particular, to an electrical interconnection system and electrical connectors for the same capable of being used for signal transmission.

BACKGROUND OF THE INVENTION

In conventional electrical communication equipment, a Printed Circuit Board (PCB) is usually used as the backpanel in an electrical communication system, and, interconnections and signal transmissions among independent electrical modules are achieved by connecting these independent electrical modules to the backpanel. Due to more and more requirements on intensity and velocity of signal transmissions in the electrical communication field, there are more attentions on developments of the backpanel. However, the existing high speed backpanel faces some challenges on its signal transmission capabilities like long distance transmission deficiency and loss of the signal. Particularly, signal transmission capabilities of the printed circuit board, as the existing backpanel, are constrained e.g. by its insulation materials and electric circuits thereon. For example, in the PCB application, epoxy resin, which is usually used as insulation materials of the PCB, has high loss factor of about 0.01; further, the electric circuit's size may be restricted due to the high density layout on the board. Especially, when the conventional PCB backpanel is used for a transmission distance of about 100 cm or more and/or a transmission speed of more than about 15 Gbps, signal loss/attenuations and transmission speed restrictions can happen.

On the other hand, electrical cables play an important role in the electrical communications and signal transmissions. Compared with PCBs, electrical cables usually have more advantages on the long distance transmission, due to its structure, material, and so on. Furthermore, insulation material in electrical cables usually have a lower loss factor, for example, less than 0.002. Also, electrical cables have cost and manufacturing advantages. Accordingly, electrical cable assemblies, other than PCB backpanels, become a trend in the electrical communications and signal transmissions.

Some efforts have been in place in the industry. For example, Chinese Patent CN102160239 discloses a high density cable assembly for printed circuit board connection. In this reference, a pin header connector is mounted on the printed circuit board, and a plurality of electrical cable assemblies are compactly arranged by a carrier and configured to mate with the header. Each electrical cable assembly includes an electrical cable termination and an electrical cable coupled to the electrical cable termination. The pin header and electrical cable terminations are configured such that each of the electrical cable terminations makes electrical contact with at least one of the contact pins. Accordingly, a number of (for example, hundreds of) cable terminations are needed for high density transmission. Further, it is costly because the cable terminations should be mounted at each of these electrical cables.

SUMMARY OF THE INVENTION

The present invention has been made to overcome or alleviate at least one aspect of the above mentioned disadvantages existing in the conventional technical solutions.

Accordingly, it is at least one object of the present invention to provide an electrical interconnection system suitable for long distance and high density electrical communications and signal transmissions.

Accordingly, it is another object of the present invention to provide an electrical receptacle connector suitable for long distance and high density electrical communications and signal transmissions.

Accordingly, it is yet another object of the present invention to provide an electrical plug connector suitable for long distance and high density electrical communications and signal transmissions.

Accordingly, it is still yet another object of the present invention to provide an electrical signal transmission system suitable for long distance and high density of electrical communications and signal transmissions.

According to one aspect of the present invention, an electrical interconnection system comprises:

a paddle card in a plate shape and having a first surface and a back to back second surface, comprising a plurality of first contact pads positioned on the first surface of the paddle card and a plurality of second contact pads positioned on the second surface of the paddle card;

a first wafer comprising a plurality of first conductors each having a first contact portion; and a second wafer comprising a plurality of second conductors each having a second contact portion;

wherein each wafer comprises a housing enclosing at least part of the plurality of first conductors and the plurality of second conductors, and each said housing comprises a mounting edge at which the wafer can be mounted onto a printed circuit board, and a mating edge at which the first and second contact portions are located;

wherein the first wafer and the second wafer are assembled together to have the first contact portion and the second contact portion face each other and be able to form a gap therebetween for accommodating at least part of the paddle card;

wherein each first contact portion is adapted to be in electrical contact with a corresponding first contact pad and each second contact portion is adapted to be in electrical contact with a corresponding second contact pad when the paddle card is at least partly accommodated in the gap.

Particularly, the electrical interconnection system may comprise more than one first wafer and more than one second wafer, wherein each of the first wafer and second wafer is in a sheet shape, and configured to be alternately arranged side by side one another, and one first wafer and one second wafer constitute a wafer unit to match with one paddle card. Preferably, each wafer is configured to be erectly mounted on a printed circuit board.

In at least one embodiment, each first conductor and each second conductor may further comprise a mounting portion, and the mounting portion is located on the mounting edge and configured to be in electrical connection with a printed circuit board. For example, at least one of the first conductors and at least one of the second conductors are signal conductors for signal transmission, and at least one of the first conductors and at least one of the second conductors are ground conductors for grounding, and each of the signal conductors and the ground conductors comprises a connecting portion fixed within a housing and alternately arranged with one another along a transverse direction of the housing, and the connecting portions of each pair of signal conductors in one wafer facing the connecting portion of a ground conductor in the other wafer when viewed from a side of the wafer. At least one of the first conductors and at least one of the second conductors are signal conductors for signal transmission, and at least one of the first conductors and at least one of the second conductors are ground conductors for grounding. The first contact portion of the signal conductor of the first wafer is configured to face the second contact portion of the ground conductor of the second wafer while the first contact portion of the ground conductor of the first wafer is configured to face the second contact portion of the signal conductor of the second wafer when viewed from a side of the wafer. The signal conductor and the ground conductor of each of the first wafer and the second wafer are alternately arranged.

Specifically, the paddle card may further comprise a plurality of electrical bonding pads configured for electrical connection with at least one electrical cable and positioned on at least one of the first surface and the second surface of the paddle card and each being electrically connected to at least one of the first contact pads and the second contact pads.

More specifically, the electrical interconnection system may further comprise at least one electrical cable (e.g. an electrical ribbon cable) in electrical connection with the first electrical bonding pads, respectively. Also, the electrical interconnection system may further comprise a printed circuit board, wherein the first wafer and the second wafer are erectly mounted on and electrically contacted with the printed circuit board.

According to another aspect of the present invention, an electrical receptacle connector comprises: at least one first wafer comprising a plurality of first conductors each having a first contact portion; and at least one second wafer comprising a plurality of second conductors each having a second contact portion; wherein each wafer (11*a*, 11*b*) comprises a housing enclosing at least part of the plurality of first conductors and the plurality of second conductors, and each said housing comprises a mounting edge at which the wafer can be mounted onto a printed circuit board, and a mating edge at which the first and second contact portions are located; wherein the first and second wafers are alternately arranged side by side one another such that each first contact portion and each second contact portion are assembled together to have the first contact portion and the corresponding second contact portion face each other and be able to form a gap therebetween and constitute a wafer unit configured to have the gap receive a paddle card to be coupled to the electrical receptacle connector.

Specifically, at least one of the first conductors and at least one of the second conductors are signal conductors for signal transmission, and at least one of the first conductors and at least one of the second conductors are ground conductors for grounding, and each of the signal conductors and the ground conductors comprises a connecting portion fixed within a housing and alternately arranged with one another along a transverse direction of the housing, and the connecting portions of each pair of signal conductors in one wafer facing the connecting portion of a ground conductor in the other wafer when viewed from a side of the wafer. More specifically, at least one of the first conductors and at least one of the second conductors are signal conductors for signal transmission, and at least one of the first conductors and at least one of the second conductors are ground conductors for grounding, the first contact portion of the signal conductor of the first wafer is configured to face the second contact portion of the ground conductor of the second wafer while the first contact portion of the ground conductor of the first wafer is configured to face the second contact portion of the signal conductor of the second wafer when viewed from a side of the wafer. Still more specifically, the gap is configured to accommodate at least part of a paddle card in a plate shape and having a first surface and a back to back second surface and comprising a plurality of first contact pads positioned on a first surface of the paddle card and a plurality of second contact pads positioned on an opposite second surface of the paddle card; each first contact portion is adapted to be in electrical contact with a corresponding first contact pad and each second contact portion is adapted to be in electrical contact with a corresponding second contact pad when the paddle card is at least partly accommodated in the gap. Preferably, each of the first wafer and second wafer is in a sheet shape and configured to be alternately arranged side by side one another. Preferably, each wafer is configured to be erectly mounted on a printed circuit board.

More specifically, each wafer comprises a housing enclosing at least part of the plurality of first conductors and the second conductors respectively, and the housing comprises a mounting edge configured to be ready for be mounted onto a printed circuit board, and a mating edge on which the first and second contact portions are located respectively. Preferably, the mating edge is orthogonal or parallel to the mounting edge.

Further, each first conductor and each second conductor further comprises a mounting portion, and the mounting portion is located on the mounting edge and configured to be in electrical connection with a printed circuit board.

The electrical receptacle connector may further comprise a receptacle housing configured to accommodate at least part of the first and second wafers, wherein the receptacle housing comprises a top wall or/and a bottom wall orthogonal to the extending direction of the gap and having an engagement mechanism to have the first and second wafers arranged together. Alternatively, the receptacle housing may be configured to accommodate the first and second contact portion, wherein the receptacle housing comprises at least one receptacle ports disposed at a first receiving end thereof and at least two rows of contact receiving apertures disposed at an opposing second receiving end thereof; and each contact portion of one wafer is configured to pass through one contact receiving aperture and the contact portions of every pair of first and second wafers are accommodated within one receptacle port. Further, the receptacle housing may comprise a plurality of guide grooves disposed on the inner surface of the top wall or/and the bottom wall and configured to position the first and second wafers in the receptacle housing. Furthermore, the electrical receptacle connector may also comprises a plurality of latch mechanisms provided for latching these first and second wafers in the receptacle housing, wherein each latch mechanism comprises a projection provided on each wafer and a corresponding locking groove disposed on the receptacle housing and engaged with the projection. In addition, the electrical receptacle connector may further comprise an alignment cover configured to at least partly enclose the first and second wafers at an end opposing to the first and second contact portion, wherein a plurality of latch mechanisms provided to latch all of the first and second wafers to the alignment cover.

According to yet another aspect of the present invention, an electrical plug connector comprises: at least one paddle cards being in a plate shape having a first surface and a back to back second surface and comprising a plurality of first contact pads positioned on the first surface of the paddle card and a plurality of second contact pads positioned on the second surface of the paddle card; and a plug housing comprising at least one opening each configured to accommodate part or whole of one paddle card therein; wherein the plug housing comprises a top wall or/and a bottom wall having a mechanical engagement part configured to engage with an external electronic device so as to have the paddle card be in electrical connection with the external electronic device, and each paddle card is orthogonal to the top wall or/and the bottom wall. For example, the mechanical engagement part comprises at least one rib or groove respectively positioned on inner surface of the top wall or/and the bottom wall.

Specifically, the paddle card comprises a plurality of electrical bonding pads configured for electrical connection with at least one electrical cable and positioned on at least one of the first surface and the second surface of the paddle card and each being electrically connected to at least one of the first electrical contact pads and the second contact pads.

Further, the electrical plug connector may comprise a cable shell removably attached to the plug housing and configured to receive at least one electrical cable to be coupled to the paddle cards. Specifically, the cable shell comprises a front end adjacent the front wall, an opposing rear end, a channel extending from the opposing rear end to the front end and configured to receive end portions of an electrical cable coupled to the plurality of paddle cards, and a pair of retaining members positioned at the front end and configured to retain the plurality of paddle cards in the plug housing. More specifically, the cable shell comprises a lower shell part and an upper shell part removably engaged with the lower shell part, wherein the channel is disposed in the lower shell part.

According to an alternative aspect of the present invention, an electrical signal transmission system comprises an electrical receptacle connector according to an aspect of the present invention; an electrical plug connector according to an aspect of the present invention; at least one electrical cable; and a printed circuit board, wherein the electrical cable is in electrical connection with the electrical plug connector, and the electrical plug connector is in electrical connection with the electrical receptacle connector, and the electrical receptacle connector is mounted on and electrically contacted with the printed circuit board.

According to still another aspect of the present invention, an electrical plug connector housing includes: a plug housing including a front wall having a plurality of openings therethrough and configured for retaining a plurality of paddle cards therein; and a cable shell removably attached to the plug housing and including a front end adjacent the front wall, an rear end, a channel extending from the rear end to the front end and configured to receive end portions of an electrical cable electrically connected to the plurality of paddle cards, and a pair of retaining members positioned at the front end and configured to retain the plurality of paddle cards in the plug housing.

According to still another aspect of the present invention, a connector is disclosed and includes first and second wafers. Each wafer includes a housing, a plurality of pairs of signal conductors and a plurality of ground conductors. The housing includes a mating edge configured to face a mating connector and orthogonal to a mounting edge configured to mount onto a board. The plurality of pairs of signal conductors and a plurality of ground conductors are fixed at least partly within the housing and alternately arranged with one another along a transverse direction of the housing, Each signal conductor and each ground conductor includes a contact portion outside and at the mating edge of the housing for contacting a corresponding contact of a mating connector, a mounting portion outside and at the mounting edge of the housing for contacting a corresponding conductive trace on a board; and a connecting portion disposed within the housing and connecting the contact portion and the mounting portion. The connecting portion has opposing longitudinal edges extending from the mating edge to the mounting edge. The contact portions of each pair of signal conductors in one wafer face the contact portion of a different corresponding ground conductor in the other wafer. And when viewed from a side of the connector, the longitudinal edges of the contact portions of the pair of signal conductors are disposed between the longitudinal edges of the contact portion of the different corresponding ground conductor.

According to still another aspect of the present invention, a plug connector housing is disclosed and including a front housing portion, a top housing portion, a bottom housing portion. The front housing portion includes: a top wall, a bottom wall, a pair of opposing side walls extending between the top and bottom walls, and a vertical front mating wall. The vertical front mating wall extends between the top, bottom and side walls and defines a plurality of spaced apart vertical slots extending therethrough. Each vertical slot is configured to receive a circuit board. The front housing portion further includes: a top flange coplanar with the top wall and extending forwardly from the mating wall, and a bottom flange coplanar with the bottom wall and extending forwardly from the mating wall. At least one first engaging member is disposed on a top side of one of the side walls behind the top wall. At least one second engaging member is disposed on a bottom side of one of the side walls behind the bottom wall. A third engaging member is disposed on an inside surface of one of the top and bottom walls. The top housing portion includes: a top wall, a pair of opposing side walls extending downwardly from the top wall. The top and side wall defines a cavity for receiving a plurality of circuit boards. A first divider extends downwardly from the top wall and is disposed between the sidewalls. At least one first engaging member is disposed on an inside surface and front of the top wall. A second engaging member is disposed on an inside surface of the top wall. A first position hole is located on a bottom of the divider. The bottom housing portion includes: a bottom wall, a pair of opposing side walls extending upwardly from the bottom wall, and a second divider extending upwardly from the top wall and disposed between the sidewalls. The bottom housing portion further includes at least one first engaging member on a top side and front of the bottom wall, and a first position hole on a top of the divider. The front, top and bottom housing portions are reversibly assembled such that the at least one first engaging member of the front housing portion engages the at least one first engaging member of the top housing portion, and the at least one second engaging member of the front housing portion engages the at least one first engaging member of the bottom housing portion. A fastener is provided to engage the first position hole of the top housing portion with the first position hole of the bottom housing portion. The plug connector housing is configured to receive at least one circuit board. The circuit board has first and second engaging members along an edge of the circuit board and an edge connector at a front of the circuit board. Each circuit board is disposed within a corresponding vertical slot with the edge connector of the circuit board extending forwardly from the mating wall between the top and bottom flanges. When the circuit board is well located, the third engaging member of the front housing portion engages the first engaging member of the circuit board, and the second engaging member of the top housing portion engages the second engaging member of the circuit board.

Concerning the above, in at least one aspect, the present invention provides an electrical interconnection system which may be used in a high speed and high density of electrical communication system. The electrical plug cable assembly according to embodiments of the present invention may substitute a conventional backpanel printed circuit board which brings signal loss/attenuations in the signal transmission adopted in the conventional electrical communication system. Accordingly, applications of the electrical interconnection system and cable assembly according to aspects of the present invention in the high speed and high density of electrical communication system may achieve long distance signal transmission with lower signal loss/attenuations than a conventional backpanel PCB, which is suitable for high density electrical communications and signal transmissions. Further, in at least one aspect, the present invention provides an electrical receptacle connector and an electrical plug cable assembly for the electrical interconnection system. Furthermore, in at least one aspect, the present invention provides an electrical signal transmission system suitable for long distance and high density of electrical communications and signal transmissions. In addition, in at least one aspect, the present invention provides an electrical plug connector housing.

BRIEF DESCRIPTION OF THE DRAWINGS

These and/or other aspects and advantages of the invention will become apparent and more readily appreciated from the following description of the embodiments of the present invention, taken in conjunction with the accompanying drawings of which.

Figure 1:
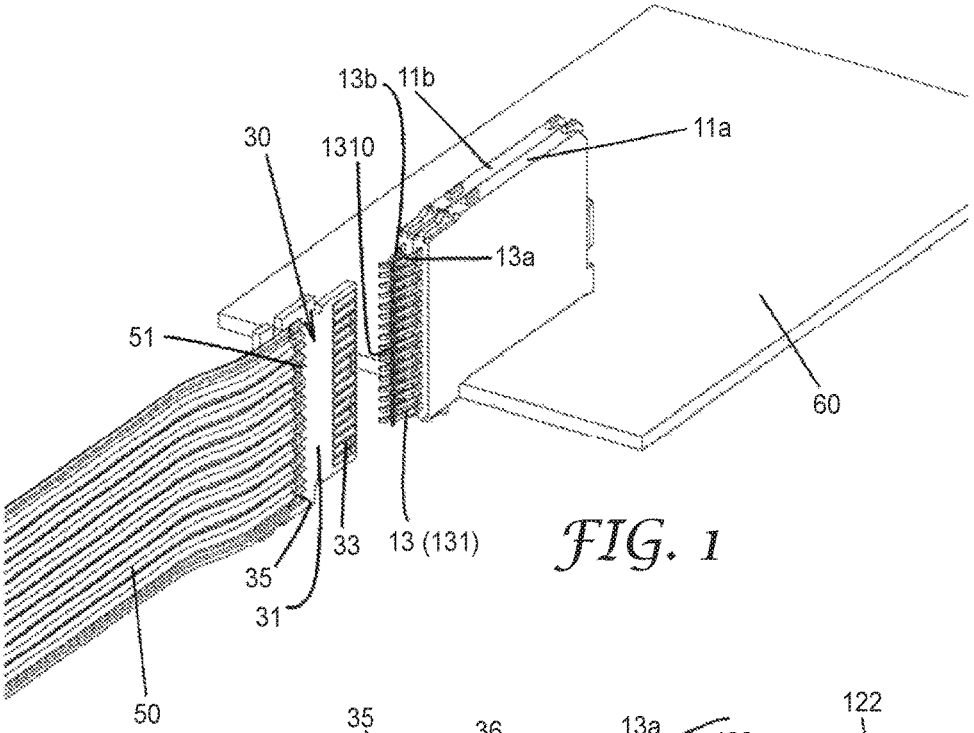
FIG. 1 is a schematic perspective view of an electrical interconnection system according to one embodiment of the present invention.

The scope of the present invention will in no way be limited to the simply schematic views of the drawings, the number of constituting components, the materials thereof, the shapes thereof, the relative arrangement thereof, etc., and are disclosed simply as an example of an embodiment.

DETAILED DESCRIPTION OF EMBODIMENTS OF THE INVENTION

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

One aspect of the present invention provides an electrical interconnection system capable of being used in long distance electrical communications and signal transmissions. Referring to FIGS. 1-7, an electrical interconnection system according to one embodiment of the present invention is provided.

Referring to FIG. 1 and FIGS. 2*a*-2*c*, an electrical interconnection system according to one embodiment of the present invention comprises a paddle card 30, a first wafer 11*a*, and a second wafer 11*b*. The paddle card 30 is in a plate shape and comprises a plurality of first contact pads 33 positioned on a first surface 31 of the paddle card 30 and a plurality of second contact pads 34 positioned on a second surface 32 back to back to the first surface 31. The first surface 31 can be also referred to as the front surface of the paddle card 30, and the second surface 32 can be also referred to as the back surface of the paddle card 30. The first wafer 11*a* comprises a plurality of first conductors 13*a* each having a first contact portion 131*a*; and the second wafer 11*b* comprises a plurality of second conductors 13*b* each having a second contact portion 131*b*. The first wafer 11*a* and the second wafer 11*b* are assembled together (e.g. assembled to form an integral or adjacently positioned) to have the first contact portion 131*a* and the second contact portion 131*b* face each other and be able to form a gap 1310 therebetween for accommodating at least part of the paddle card 30. Each first contact portion 131*a* is adapted to be in electrical contact with a corresponding first contact pad 33 and each second contact portion 131*b* is adapted to be in electrical contact with a corresponding second contact pad 34 when the paddle card 30 is at least partly accommodated in the gap 1310.

In the embodiments of this disclosure, the gap between the first contact portion 131*a* and the second contact portion 131*b* may be formed when the paddle card 30 is inserted by force, and before the paddle card 30 is accommodated there the first contact portion 131*a* and the second contact portion 131*b* may be in contact with each other. For example, the first contact portion 131*a* and the second contact portion 131*b* may have an angled lead-in portion to allow insertion of the paddle card and other portion of the contact portion (131*a*,131*b*) may be straight and in touch with each other. Or, the first wafer 11*a* and the second wafer 11*b* are assembled in a way that there is a slit with certain width between the first contact portion 131*a* and the second contact portion 131*b* before the paddle card 30 is accommodated there.

In the electrical interconnection system according to other embodiment of the present invention, there are many paddle cards 30 and many corresponding units of the first and second wafers 11*a*, 11*b* provided for high density electrical communications and signal transmissions among different modules (such as the PCBs 60) by electrical cables (such as an assembly of electrical cables 50).

According to one embodiment of the present invention, as shown in FIG. 1 and FIGS. 2*a*-2*c*, one first wafer 11*a* and one second wafer 11*b* constitute a wafer unit which is for being electrically connected with one paddle card 30 in the electrical interconnection system. Referring to FIG. 1 and FIGS. 2*a*-2*c*, the first wafer 11*a* and the second wafer 11*b* each is generally in a rectangular plate shape and is configured to be erectly mounted on a printed circuit board 60 for being electrically connected to the printed circuit board 60. The first wafer 11*a* and the second wafer 11*b* each comprises at least one pair of signal conductors for signal transmission and at least one ground conductor for grounding. In the wafer unit, the first wafer 11*a* and the second wafer 11*b* are arranged such that a signal conductor of the first wafer 11*a* faces a ground conductor of the second wafer 11*b* while a ground conductor of the first wafer 11*a* faces a signal conductor of the second wafer 11*b*. Correspondingly, in the case where a number of wafer units are provided side by side one another, a signal conductor of the first wafer 11*a* in one wafer unit face a ground conductor of the second wafer 11*b* in an adjacent wafer unit while a ground conductor of the first wafer 11*a* in the one wafer unit faces a signal conductor of the second wafer 11*b* in another adjacent wafer unit.

Referring to FIG. 1 and FIGS. 2*a*-2*c*, in a wafer unit, each of the first wafer 11*a* and the second wafer 11*b* comprises a plurality of signal conductors for signal transmission and a plurality of ground conductors for grounding alternately arranged with the signal conductors. Alternatively, in the wafer unit, signal conductors of the first wafer 11*a* face corresponding ground conductors of the second wafer 11*b*, while ground conductors of the first wafer 11*a* face corresponding signal conductors of the second wafer 11*b*. For example, in the embodiment shown in FIG. 1 and FIGS. 2*a*-2*c*, there are eight conductors, i.e., four signal conductors and four ground conductors arranged in an alternate manner, in one wafer 11*a* or 11*b*. Of course, in another embodiment according to the present invention, number of these conductors may be vary, such as, twelve or sixteen.

In at least one aspect, the ground conductors in one wafer serve as isolator and return path for adjacent signal conductors in same wafer. In at least one aspect, the ground conductors in one wafer serve as reference plane and shield to form a stripline structure for signal conductors in adjacent alternate wafers. For specific signal conductors, the effect of ground conductors in same wafer and adjacent alternate wafer contributes to providing desired characteristic impedance and crosstalk isolation.

Every conductor 13, 13*a*, 13*b* of the signal conductors and the ground conductors in the wafer 11*a* or 11*b* of a wafer unit comprises a contact portion 131*a* or 131*b*. That is, as mentioned in the above, the first wafer 11*a* comprises the plurality of first conductors 13*a* each having a first contact portion 131*a*; and the second wafer 11*b* comprises the plurality of second conductors 13*b* each having a second contact portion 131*b*. And, the first wafer 11*a* and the second wafer 11*b* in one wafer unit are assembled together to have the first contact portion 131*a* and the second contact portion 131*b* face each other and be able to form a gap 1310 therebetween for accommodating at least part of the paddle card 30.

In this description, although in some embodiment, in one wafer unit, the first contact portion 131*a* of the first wafer 11*a* and the second contact portion 131*b* of the second wafer 11*b* may be configured in an opposite deformation direction (in order to form the gap 1310) at the end while the respective signal conductors (paths) and the respective ground conductors (paths) in the first wafers 11*a* are arranged to face the respective ground conductors (paths) and the respective signal conductors (paths) in the second wafer 11*b*, the first wafers 11*a* and the second wafers 11*b* are generally the same outline and have a similar (opposed) conductor arrangement. Accordingly, in the following description and its accompanying drawings, a wafer signed by number "11" denotes either the first wafer 11*a* or the second wafer 11*b*; similarly, a plurality of conductors (including the signal conductors and the ground conductors) signed by number "13" denotes either the plurality of first conductors 13*a* or the plurality of second conductors 13*b*; and, contact portions signed by number "131" denotes either the first contact portion 131*a* or the second contact portion 131*b*, etc., for clarity and concision purposes.

Since there is such a wafer unit (including one first wafer 11*a* and one second wafer 11*b*) provided in the electrical interconnection system as shown in FIG. 1 and FIGS. 2*a*-2*c* and configured to be erectly mounted on a printed circuit board 60, in at least one embodiment, many wafer units may be arranged side by side on the printed circuit board 60, to realize a high density arrangement.

According to one embodiment of the present invention, each wafer 11 (11*a*, 11*b*) has a housing 12 enclosing at least part of the plurality of conductors 13 (i.e., the plurality of first conductors 13*a* and the plurality of second conductors 13*b*) respectively therein. Each housing 12 comprises a mounting edge 122 where the wafer is to be mounted onto a printed circuit board 60 and a mating edge 121 where the contact portions 131 (i.e., the first contact portions 131*a* and the second contact portions 131*b*) are located. In at least one embodiment, the mating edge 121 is orthogonal or parallel to the mounting edge 122. For example, in the embodiment shown in FIGS. 2*a*-2*c*, the housing 12 of the wafer 11 is in a substantially rectangular shape and the mating edge 121 is orthogonal to the mounting edge 122. Nevertheless, the mating edge 121 of the housing 12 may be at any angle relative to the mounting edge 122 in other embodiments of the present invention.

Each of the conductors 13 comprises a mounting portion 133, and the mounting portion 133 is located at the mounting edge 122 of the housing 12 and configured to be in electrical connection with the printed circuit board 60. Each of the conductors 13 further comprises a connecting portion 132 disposed within the housing 12 and connecting the contact portion 131 and the mounting portion 133. In at least one embodiment, each of the signal conductors and the ground conductors have the connecting portion 132 fixed within the housing 12 and alternately arranged with one another along a transverse direction of the housing 12, and the connecting portion 132 of the signal conductor in one wafer 11*a* or 11*b* faces the connecting portion 132 of the ground conductor in the other wafer 11*b* or 11*a* when viewed from a side of the wafer. And, in one wafer unit, the signal conductor and the ground conductor of each of the first wafer 11*a* and the second wafer 11*b* are alternately arranged.

Referring to FIG. 1 and FIGS. 2*a*-2*c*, as mentioned above, the paddle card 30 comprises a plurality of first contact pads 33 positioned on the first surface 31 and a plurality of second contact pads 34 positioned on an opposite second surface 32. Further, the paddle card 30 may comprise a plurality of electrical bonding pads 35 configured for electrical connection with at least one electrical cable 50. As shown in FIG. 1 and FIG. 2*a*-2*c*, these electrical bonding pads 35 are positioned on at least one of the first surface 31 and the second surface 32 of the paddle card 30 and each being electrically connected to at least one of the first contact pads 33 and the second contact pads 34. For example, in the embodiment shown in FIGS. 2*a*-2*c*, these electrical bonding pads 35 are positioned on the first surface 31 of the paddle card 30 while being electrically connected to the respective first contact pads 33 on the first surface 31 of the paddle card 30 and the respective second contact pads 34 on the second surface 32 of the paddle card 30. The paddle card 30 may further comprise a pair of electrical ground pads 36 provided for example at both outer ends of the plurality of electrical bonding pads 35 and configured for grounding.

According to one embodiment of the present invention, referring to FIG. 1 and FIG. 2*a*-2*c*, the electrical interconnection system may further comprise at least one electrical cable 50 in electrical connection with the first electrical bonding pads 35, respectively. In at least one embodiment, the at least one electrical cable 50 may be embodied as a ribbon cable The at least one electrical cable 50 may have any suitable cable configuration, including but not limited to a coaxial cable, a twinaxial cable, a shielded cable, and an unshielded cable.

According to one embodiment of the present invention, referring to FIG. 1, the electrical interconnection system may comprise one or more printed circuit board 60. The first wafers 11*a* and the second wafers 11*b* are erectly mounted on and electrically contacted with the printed circuit board 60, such that one or more units of the first and second wafers 11*a*, 11*b* may be arranged side by side on the printed circuit board 60. This mounting and arranging allows for expanding the wafer units so as to achieve high density signal transmission.

Then, referring to FIGS. 2*a*-2*c*, 3 and 4, an electrical receptacle connector 10 according to one embodiment of the present invention is provided. The electrical receptacle connector 10 comprises at least one first wafer 11*a* and at least one second wafer 11*b*. Each first wafer 11*a* comprises a plurality of first conductors 13*a* each having a first contact portion 131*a*. Each second wafer 11*b* comprises a plurality of second conductors 13*b* each having a second contact portion 131*b*. One first wafer 11*a* and one second wafer 11*b* are assembled together (including adjacently positioned) to have the first contact portions 131*a* and the corresponding second contact portions 131*b* face each other and be able to form a gap 1310 therebetween. Alternatively, the first and second wafers 11*a*, 11*b* are alternately arranged side by side one another and one first wafer and one second wafer constitute a wafer unit configured to have the gap 1310 receive a paddle card 30 to be coupled to the electrical receptacle connector 10. Alternatively, the gap 1310 is configured to accommodate at least part of a paddle card 30.

The paddle card 30 comprises a plurality of first contact pads 33 positioned on a first surface 31 of the paddle card 30 and a plurality of second contact pads 34 positioned on an opposite second surface 32 of the paddle card 30. Each first contact portion 131*a* is adapted to be in electrical contact with a corresponding first contact pad 33 and each second contact portion 131*b* is adapted to be in electrical contact with a corresponding second contact pad 34 when the paddle card 30 is at least partly accommodated in the gap 1310.

According to one embodiment of the present invention, each of the first wafer 11*a* and second wafer 11*b* is in a plate shape and configured to be alternately arranged side by side one another. In at least one aspect, each wafer 11 is configured to be mounted on a printed circuit board 60. In at least one aspect, each wafer 11 comprises a housing 12 enclosing at least part of the plurality of conductors 13 respectively, and the housing 12 comprises a mounting edge 122 where the wafer is to be mounted onto a printed circuit board 60, and a mating edge 121 at which the first and second contact portions 131*a*, 131*b* are located respectively. In at least one aspect, the mating edge 121 is orthogonal or parallel to the mounting edge 122. For example, in the embodiment shown in FIGS. 2*a*-2*c*, the housing 12 of the wafer 11 is in a substantially rectangular shape and the mating edge 121 is orthogonal to the mounting edge 122.

Each of the conductors 13 comprise a mounting portion 133, and the mounting portion 133 is located at the mounting edge 122 and configured to be in electrical connection with the printed circuit board 60. Also, each of the conductors 13 also comprises a connecting portion 132 disposed within the housing 12 and connecting the contact portion 131 and the mounting portion 133. Specifically, the contact portions 131 of the conductors 13 are provided outside and at the mating edge 121 of the housing 12, the mounting portions 133 are outside and at the mounting edge 122 of the housing 12 for contacting a corresponding conductive trace 61 on a printed circuit board 60; and the connecting portions 132 are disposed within the housing 12 and connecting the contact portion 131 and the mounting portion 133. In other words, the electrical receptacle connector 10 may be an assembly of several above-mentioned wafer units.

Figure 2A:
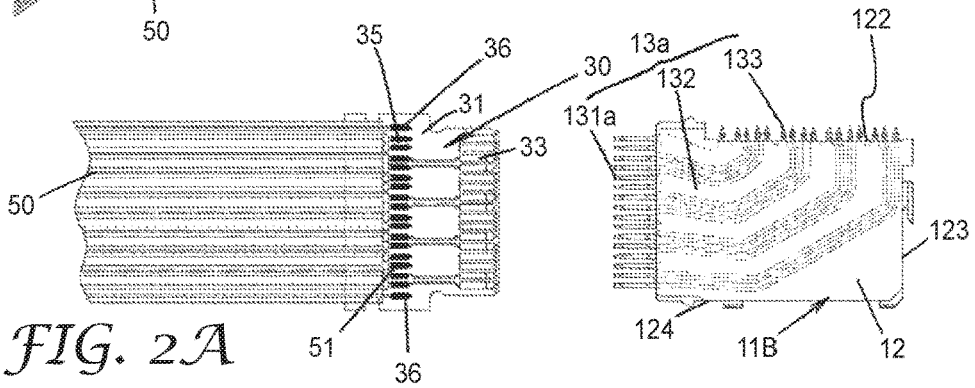
FIG. 2*a*, 2*b*, 2*c* are schematic side views of the electrical interconnection system according to one embodiment of the present invention.
Figure 2B:
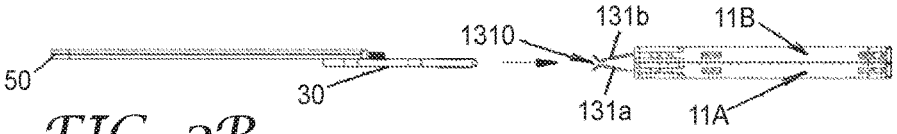
Figure 2C:
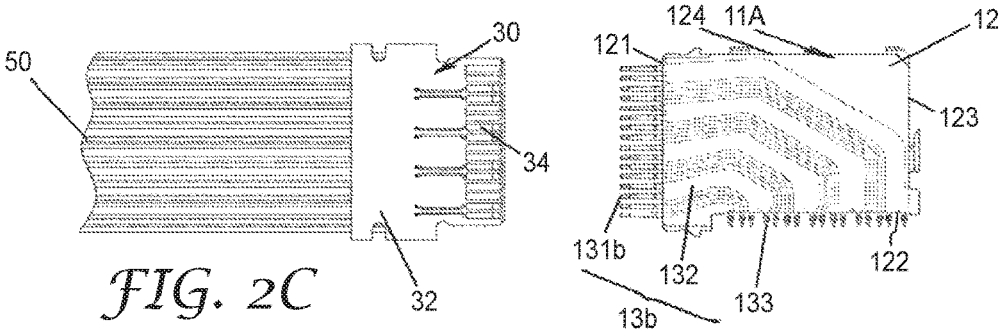
Figure 3:
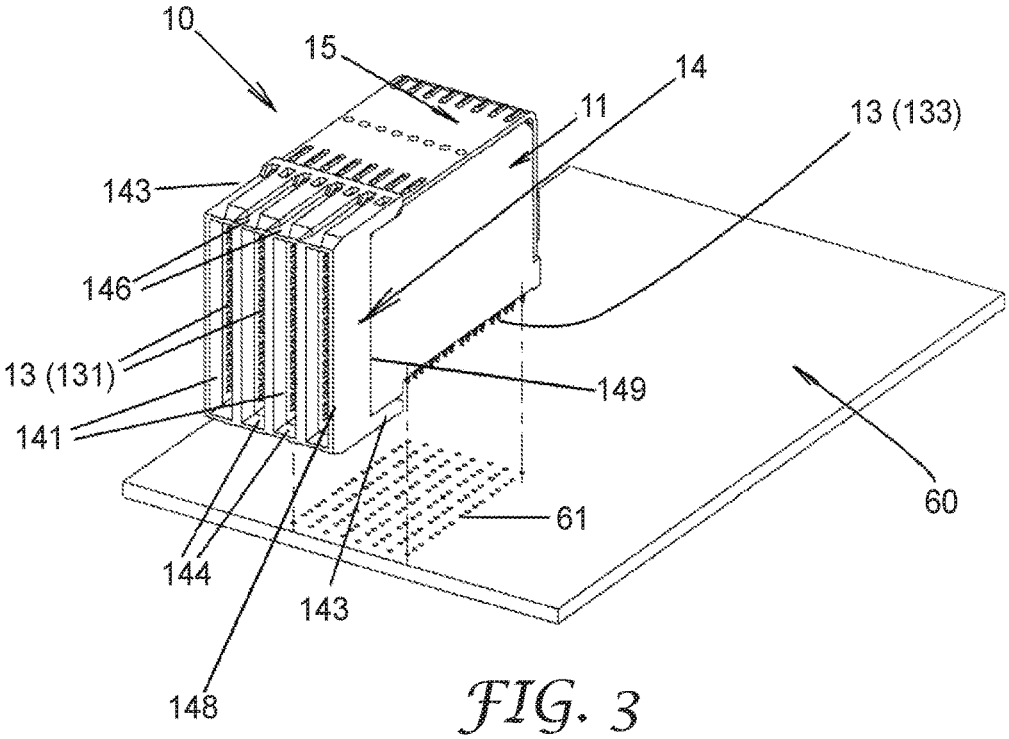
FIG. 3 is a schematic perspective view of an electrical receptacle connector, with a PCB to be connected thereto, according to one embodiment of the present invention.
Figure 4:
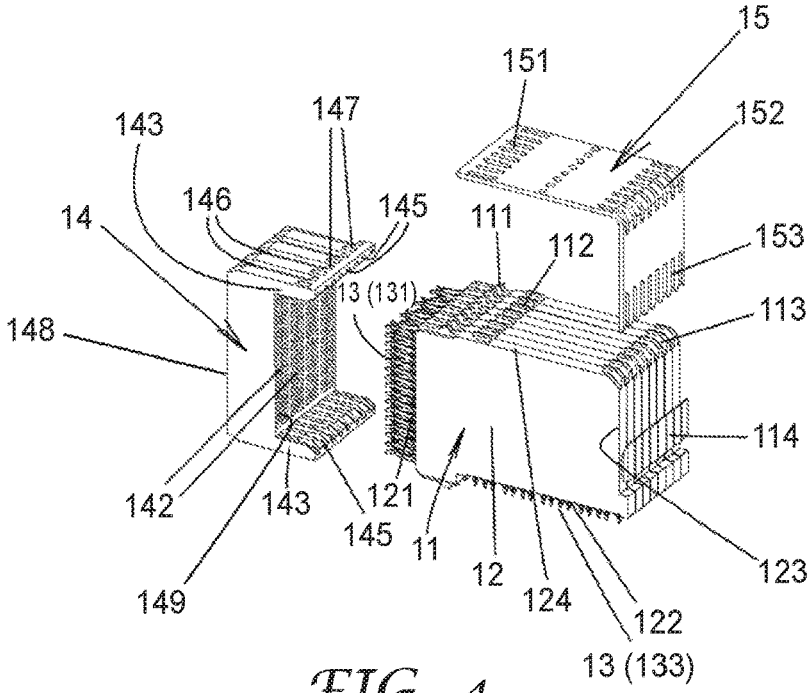
FIG. 4 is an exploded schematic perspective view of the electrical receptacle connector according to one embodiment of the present invention.

According to one embodiment of the present invention, referring to FIGS. 3 and 4, the electrical receptacle connector 10 may further comprise a receptacle housing 14 configured to accommodate at least part of the first and second wafers therein. Alternatively, the receptacle housing 14 is configured to accommodate the first and second contact portions 131*a*, 131*b* of the first and second wafers 11*a*, 11 *b*. The receptacle housing 14 comprises at least one receptacle port 141 disposed at a first receiving end 148 thereof and at least two rows of contact receiving apertures 142 disposed at an opposing second receiving end 149 thereof. Each contact portion 131 of one wafer 11 is configured to pass through one contact receiving aperture 142, and the contact portions 131 of every pair of first and second wafers 11*a*, 11*b* are accommodated within one receptacle port 141. For example, accordingly, in the embodiment shown in FIGS. 2 and 3, there are four wafer units (i.e., four first wafers 11*a* and four second wafers 11*b*) arranged with one another in the electrical receptacle connector 10, and correspondingly, four receptacle ports 141 and eight rows of contact receiving apertures 142 are disposed in the receptacle housing 14. Every two rows of contact receiving apertures 142 are intercommunicated with one corresponding receptacle port 141. In at least one embodiment, guide edges 144 (shown in FIG. 3) are disposed on these receptacle ports 141, for smooth connection of the electrical receptacle connector 10 with a mating connector, e.g. the paddle card 30 as disclosed above.

The receptacle housing 14 comprises top and bottom walls 143 orthogonal to the extending direction of the gap 1310 and having an engagement mechanism to have the first and second wafers 11*a*, 11*b* arranged together. The engagement mechanism may comprise a plurality of first guide grooves 145 disposed on the inner surfaces of one or both top and bottom walls 143 of the receptacle housing 14 and configured to position the first and second wafers 11 in the receptacle housing 14, in order to guide and position the contact portions 131 in the corresponding rows of contact receiving apertures 142. Alternatively, a plurality of secondary guide grooves 146 may be disposed on outside surfaces of both top and bottom walls 143. The secondary guide grooves serve to help the receptacle housing 14 mated with corresponding mating connector, for instance, serve to guide the electrical receptacle connector 10 during mating to a mating connector. Provision of the guide structure helps smooth connection between the receptacle housing 14 and these wafer units.

Alternatively, referring to FIGS. 3 and 4, in order for retention of these wafers 11 in the receptacle housing 14, a plurality of latch mechanisms are provided for latching these first and second wafers 11 in the receptacle housing 14. Each latch mechanism may comprise a projection 111 provided on each wafer 11 and a corresponding locking groove 147 may be disposed on the receptacle housing 14 and engaged with the projection 111. Alternatively, the projection 111 can be provided at the mounting edge 122 and/or an edge 124 opposing to the mounting edge 122 of the housing 12 of a wafer 11 and the corresponding locking groove (through hole) 147 can be disposed on the corresponding first guide grooves 145 of the receptacle housing 14 and engaged with the projection 111.

According to one embodiment of the present invention, the electrical receptacle connector 10 may further comprise an alignment cover 15 configured to at least partly enclose the first and second wafers 11*a*, 11*b* at an edge opposite the first and second contact portions, for helping to protect and position these wafers 11. As shown in FIGS. 3 and 4, the alignment cover 15 is provided to cover at least an edge 123 opposite the mating edge 121 and an edge 124 opposite the mounting edge 122 of the housing 12 of one wafer 11. A plurality of latch mechanisms may be provided to latch all of the first and second wafers 11 to the alignment cover 15. Referring to FIG. 4, for example, the latch mechanism may comprise a plurality of first projections 112 each provided at the edge 124 opposite the mounting edge 122 of the housing 12 of each wafer 11 and a plurality of first corresponding locking through holes 151 each disposed on the alignment cover 15 for engagement with the corresponding first projection 112. The latch mechanisms may further comprise a plurality of second projections 113 each provided on a corner between the edge 124 opposite the mounting edge 122 and the edge 123 opposite the mating edge 121 of the housing 12 of each wafer 11, and a plurality of corresponding second locking through holes 152 each disposed on a corresponding location of the alignment cover 15 for engagement with the corresponding second projection 113. The latch mechanisms may further comprise a plurality of third bar projections 114 each provided on the edge 123 opposite the mating edge 121 of the housing 12 of each wafer 11 and a plurality of corresponding third locking slots 153 each disposed on a corresponding location of the alignment cover 15 for engagement with the corresponding third bar projection 114.

Figure 5:
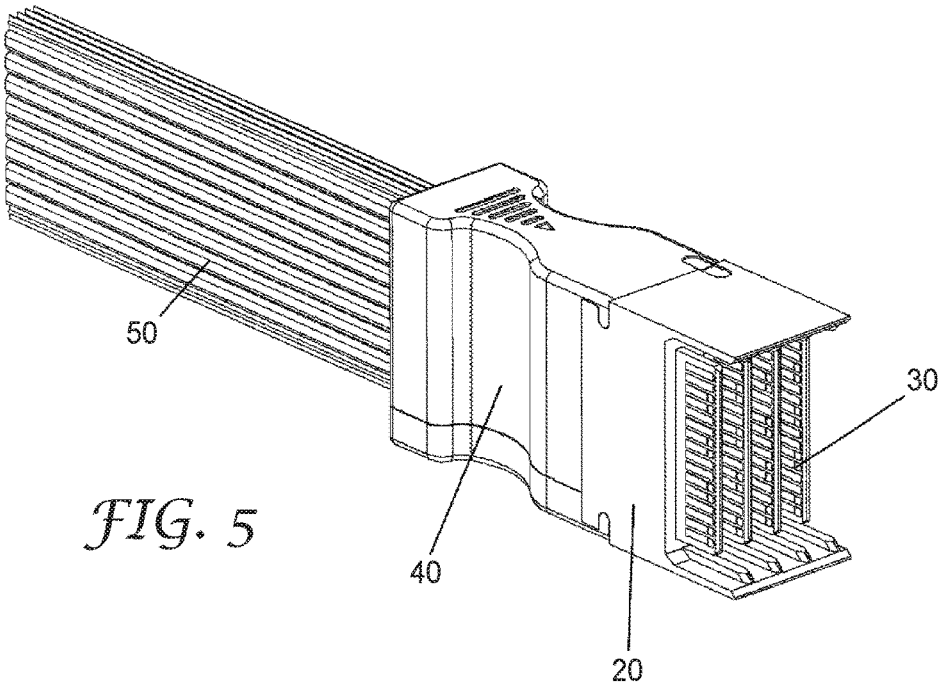
FIG. 5 is a schematic perspective view of an electrical plug connector, with an electrical cable to be connected thereto, according to one embodiment of the present invention.
Figure 6:
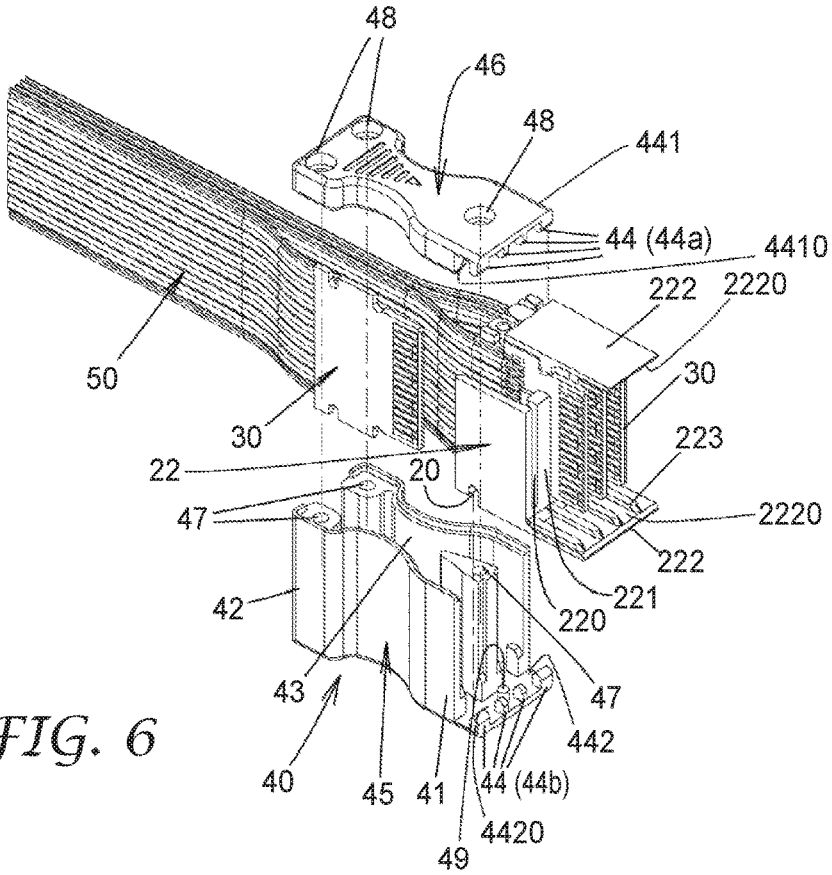
FIG. 6 is an exploded schematic perspective view of the electrical plug connector according to one embodiment of the present invention.

Referring to FIGS. 5 and 6, an electrical plug connector 20 according to one embodiment of the present invention, matable with the above electrical receptacle connector 10, is provided. The electrical plug connector 20 comprises: at least one paddle card 30 and a plug housing 22. As shown in FIGS. 2*a*-2*c*, each paddle card 30 comprises a plurality of first contact pads 33 positioned on a first surface 31 of the paddle card 30 and a plurality of second contact pads 34 positioned on an opposite second surface 32 of the paddle card 30. Back to FIGS. 5 and 6, the plug housing 22 comprises at least one opening 220 configured to accommodate part or whole of a paddle card 30 therein. The plug housing 22 further comprises opposing top and bottom walls 222 having a mechanical engagement part configured to engage with an external electronic device so as to have the paddle card 30 be in electrical connection with the external electronic device (such as the electrical cable 50 for example). Each paddle card 30 is orthogonally arranged to the top and bottom walls 222.

The paddle card 30 can be electrically coupled to an electrical cable 50 and electrically contacted with the electrical receptacle connector 10. As shown in FIGS. 2*a*-2*c*, the paddle card 30 includes a plurality of first electrical contact pads 33 positioned on a first surface 31 of the paddle card 30 and a plurality of second electrical contact pads 34 positioned on an opposing second surface 32 of the paddle card 30. Each of these electrical contact pads 33, 34 are configured to make electrical contact with one contact portion 131 of each conductor 13 in the electrical receptacle connector 10. The paddle card 30 further comprises a plurality of electrical bonding pads 35 configured for electrical connection with at least one electrical cable 50 and positioned on at least one of the first surface 31 and the second surface 32 of the paddle card 30 and each being electrically connected to one of the first electrical contact pads 33 and the second contact pads 34 of the paddle card 30. These electrical bonding pads 35 are configured to receive end portions 51 of an electrical cable 50 coupled to the paddle card 30. Alternatively, the paddle card 30 may comprise a plurality of first electrical bonding pads 35 positioned on a first surface 31 of the paddle card 30 and each being electrically connected to the first electrical contact pad 33 and a plurality of second electrical bonding pads (not shown) positioned on an opposing second surface 32 of the paddle card 30 and each being electrically connected to the second electrical contact pad 34. The first and/or second electrical contact pads 33, 34 are configured to receive end portions 51 of an electrical cable 50 coupled to the paddle card 30. In addition, the paddle card 30 may further comprise a pair of electrical ground pads 36 provided at both outer lateral of the plurality of electrical cable pads 35 and configured for grounding.

Referring to FIG. 6, the plug housing 22 may include a front wall 221 having a plurality of openings 220 therethrough, each opening being configured to receive one paddle card 30 in the plug housing 22.

The top and bottom walls 222, which correspond to the top and bottom walls 143 of the receptacle housing 14, extend from both ends of plug housing 22. The mechanical engagement part comprises a plurality of ribs 223 disposed on inside surfaces 2220 of both top and bottom walls 222, respectively. The ribs 223 of the plug housing 22 is configured for engagement with corresponding secondary guide grooves 146 of the receptacle housing 14 such that the plug housing 22 and the receptacle housing 14 are smoothly connected with each other.

Referring to FIG. 6, the electrical plug connector 20 may further comprise a cable shell 40 removably attached to the plug housing 22 and configured to receive at least one electrical cable 50 to be coupled to the paddle cards 30.

The cable shell 40 comprises a front end 41 adjacent the front wall 221, an opposing rear end 42, a channel 43 extending from the rear end 42 to the front end 41 and configured to receive end portions 51 of an electrical cable 50 coupled to the plurality of paddle cards 30, and a pair of retaining members 44 positioned at the front end 41 and configured to retain the plurality of paddle cards 30 in the plug housing 22. The pair of retaining members 44 comprises several top wall retaining members 44*a* disposed on the inside surface 4410 of the top wall 441 of the cable shell 40 and several corresponding bottom wall retaining members 44*b* disposed on the inside surface 4420 of the bottom wall 442 of the cable shell 40. Preferably, one pair of top wall and bottom wall retaining members 44 is provided to engage with corresponding retaining grooves disposed at both outer lateral ends of one paddle card 30, respectively, so as to retain one paddle card 30 in the plug housing 22. For example, in the embodiment shown in FIG. 6, four pairs of top wall and bottom wall retaining members 44 are provided for retaining four paddle cards 30 in the plug housing 22, respectively.

A retaining mechanical arrangement may be provided for latching the plug housing 22 to the cable shell 40. For example, the retaining mechanical arrangement may comprise a pair of retaining grooves 224 disposed at a rear end of the plug housing 22 (i.e., at both outer lateral ends of the rear end of plug housing 22 shown in FIG. 6), and two retaining members 44 (i.e., the outermost pair of the retaining members 44) of the cable shell 40. The pair of retaining grooves 224 and the outmost pair of retaining members 44 are engaged with respect to each other so as to mount the plug housing 22 and the cable shell 40 together. The retaining mechanical arrangement may further comprise a pair of retaining pins 49 disposed respectively on the inside surfaces of the top wall and the bottom wall of the cable shell 40, to provide additional security in mounting the plug housing 22 and the cable shell 40 together.

As shown in FIG. 6, the cable shell 40 includes a lower shell part 45 and an upper shell part 46 removably engaged with the lower shell part 45. The channel 43 is disposed in the lower shell part 45. Further, a plurality of locking members 47 (for example, one at the front end 41 while two at the opposing rear end 42) is disposed in the channel 43 of the lower shell part 45. A plurality of corresponding locking holes 48 (for example, one at the front end 41 while two at the opposing rear end 42, correspondingly) is disposed in the upper shell part 46. The lower shell part 45 and the upper shell part 46 are detachably fixed together when fasteners are provided extending through locking holes 48 and into corresponding locking members 47.

In accordance with principles and spirits of the present invention, an embodiment of the present invention also provides an electrical signal transmission system for high-speed signal transmission.

Figure 7:
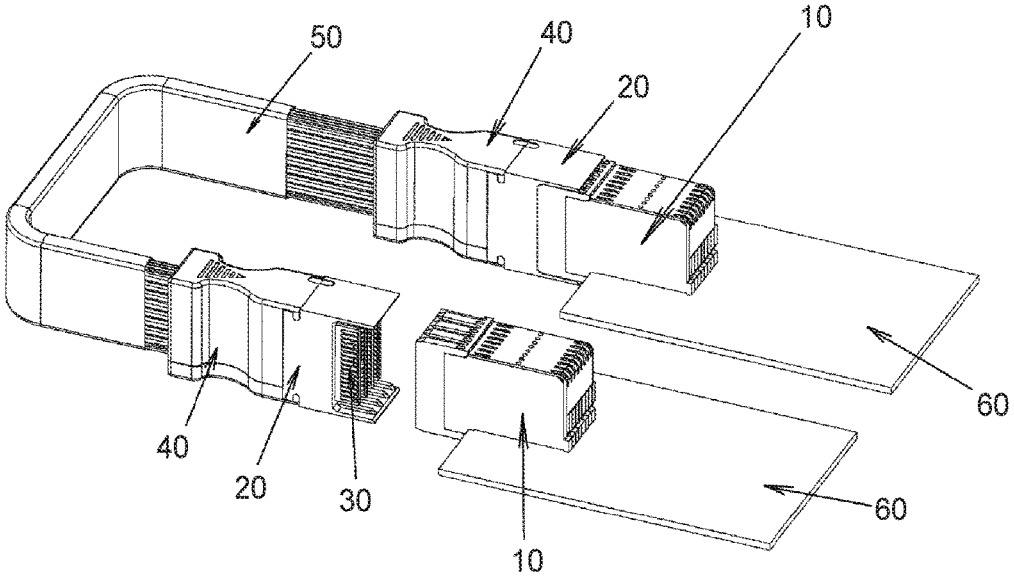
FIG. 7 is a schematic perspective view of an application of an electrical signal transmission system according to one embodiment of the present invention.

FIG. 7 shows an application of an electrical signal transmission system according to one embodiment of the present invention. Referring to FIG. 7, the electrical signal transmission system mainly comprises two electrically receptacle connectors 10, two electrical plug connectors 20 each having a plurality of paddle cards 30 therein and connectable with the corresponding electrical receptacle connector 10, assembly of electrical cables 50, and two printed circuit board 60. Each electrical receptacle connector 10 includes four wafer units arranged side by side while each wafer in the wafer unit is mounted on and electrically contacted with the corresponding printed circuit board 60. The assembly of electrical cables is provided for being in electrical connection between the two electrical plug connectors 20. And, each of the two electrical plug connectors 20 is in electrical connection with corresponding electrical receptacle connector 10 by electrical connections among these wafer units and these corresponding paddle cards 30. In this way, these printed circuit boards (PCB) 60 are electrically connected by assembly of the electrical cables 50 through electrical connections between the electrical receptacle connectors 10 and the corresponding electrical plug connectors 20. Accordingly, in at least one aspect, this electrical signal transmission system can provide long distance signal transmission with lower signal loss/attenuations than a conventional backpanel PCB.

Figure 8:
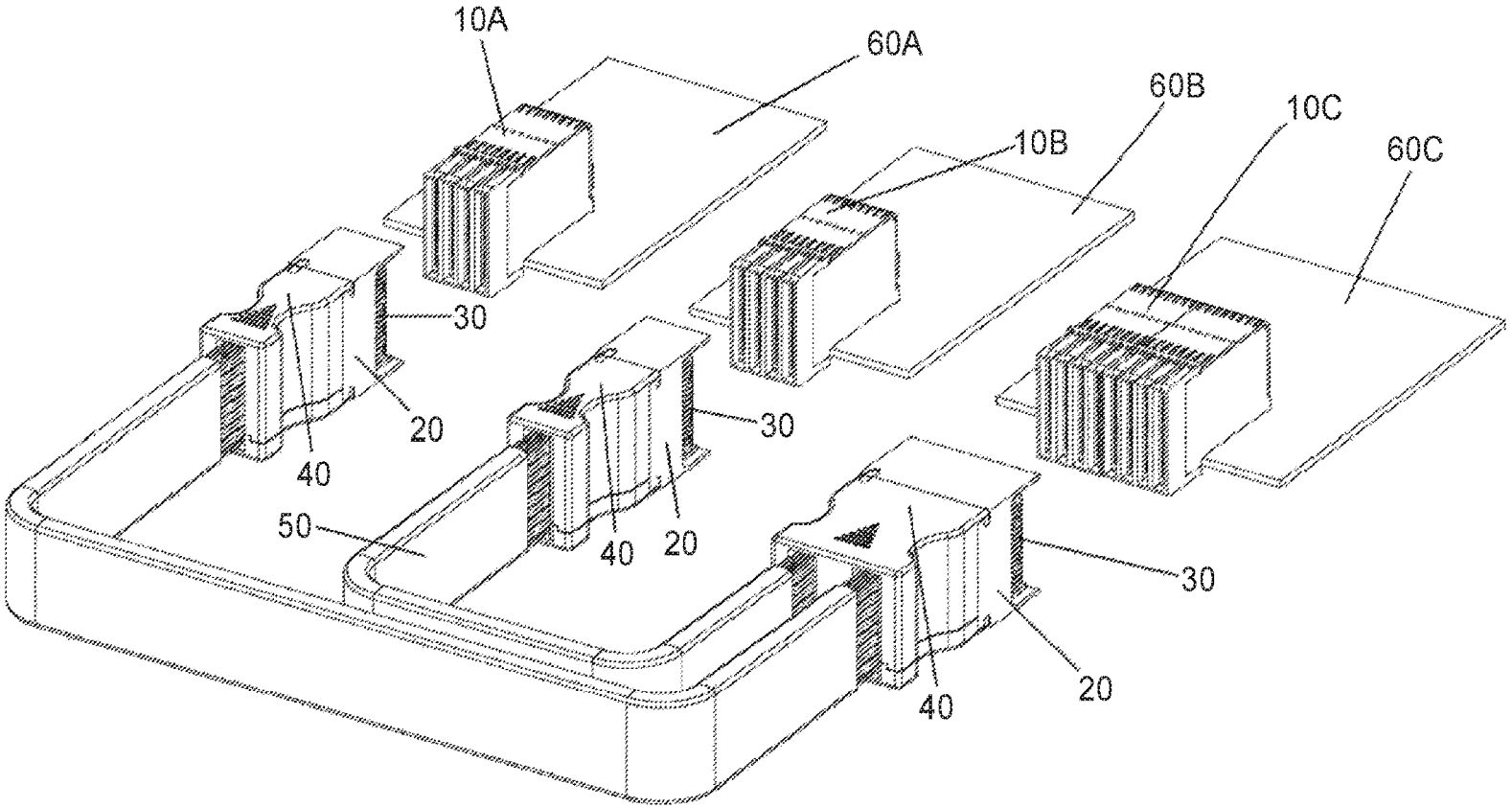
FIG. 8 is a schematic perspective view of another application of an electrical signal transmission system according to one embodiment of the present invention.

FIG. 8 shows another application of an electrical signal transmission system according to an embodiment of the present invention. The electrical signal transmission system mainly comprises three electrical receptacle connectors 10A, 10B, 10C (especially, two connectors having four wafer units while one connector has eight wafer units, as shown in FIG. 8) respectively being mounted on and being electrically connected with three individual printed circuit boards 60A, 60B, 60C, and three electrical plug connectors 20A, 20B, and 20C in which a plurality of corresponding paddle cards 30 are provided. The three electrical plug connectors 20A, 20B, and 20C, each covered by the respective cable shells 40, are electrically connected by two electrical cables 50A and 50B. In the illustrated embodiment, electrical plug connectors 20A and 20C are electrically connected by electrical cable 50A, and electrical plug connector 20B and 20C are electrically connected by electrical cable 50B. In the electrical signal transmission system shown in FIG. 8, the three electrical plug connectors 20A, 20B, and 20C are connectable with the corresponding electrical receptacle connectors 10A, 10B, and 10C, respectively, to achieve the electrical signal transmission system.

Consequently, the electrical signal transmission system according to embodiments of the present invention is suitable for high density electrical communications and signal transmissions. Further, applications of the electrical connector and cable assembly according to aspects of the present invention in high speed and high density electrical communication systems may achieve long distance signal transmission with lower signal loss/attenuations than a conventional backpanel PCB.

According to an alternative aspect of the present invention, an electrical plug connector housing is provided. The electrical plug connector housing includes: a plug housing 22 including a front wall 221 having a plurality of openings 220 therethrough and configured for retaining a plurality of paddle cards 30 therein; and a cable shell 40 removably attached to the plug housing 22 and including a front end 41 adjacent the front wall, an rear end 42, a channel 43 extending from the rear end to the front end and configured to receive end portions of an electrical cable 50 electrical connected to the plurality of paddle cards, and a pair of retaining members 44 positioned at the front end and configured to retain the plurality of paddle cards in the plug housing.

Figure 9:
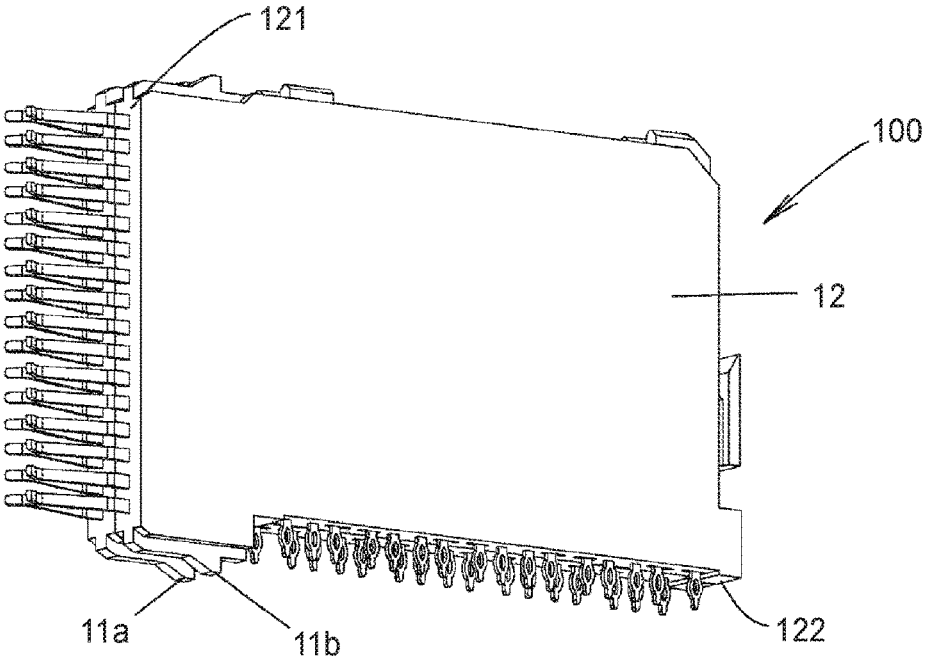
FIG. 9 is a schematic perspective view of an electrical connector, according to one embodiment of the present invention.
Figure 10:
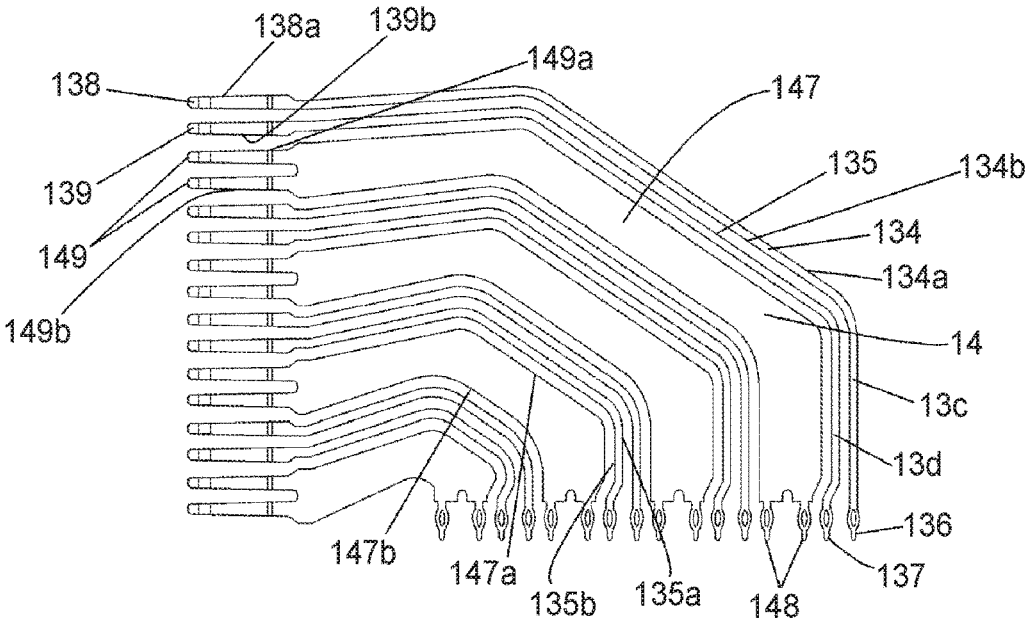
FIG. 10 is a schematic view of some conductors contained in the wafer of the connector shown in FIG. 9.

According to an alternative aspect of the present invention, in one embodiment, a connector is disclosed. As shown in FIGS. 9 and 10, the connector 100 includes at least one first wafer 11*a* and at least one second wafer 11*b*. Each wafer 11*a*, 11*b* includes a housing 12, a plurality of pairs of signal conductors 13*c*, 13*d* and a plurality of ground conductors 14. The housing 12 includes a mating edge 121 configured to face a mating connector (e.g. a paddle card) and orthogonal to a mounting edge 122 configured to mount onto a board (e.g. printed circuit board). The plurality of pairs of signal conductors 13*c*, 13*d* and the plurality of ground conductors 14 are fixed at least partly within the housing 12 and alternately arranged with one another along a transverse direction of the housing 12.

Each signal conductor 13*c*, 13*d* and each ground conductor 14 includes a contact portion 138, 139, 149, a mounting portion 136, 137, 148 and a connecting portion 134,135, 147. The contact portion 138, 139, 149 is outside and at the mating edge 121 of the housing 12 for contacting a corresponding contact of a mating connector. The mating connector can be the electrical plug connector as mentioned above. The mounting portion 136, 137, 148 is outside and at the mounting edge 122 of the housing for contacting a corresponding conductive trace on a board. The connecting portion 134, 135, 147 is disposed within the housing 12 and connecting the contact portion 138, 139, 149 and the mounting portion 136, 137, 148.

The connecting portion 134, 135, 147 has opposing longitudinal edges 134*a*, 1134*b*; 135*a*, 135*b*; 147*a*, 147*b* extending from the mating edge 121 to the mounting edge 122. The contact portions 138, 139 of each pair of signal conductors 13*c*, 13*d* in one wafer face the contact portion 149 of a different corresponding ground conductor 14 in the other wafer. And when viewed from a side of the connector, the longitudinal edges 138*a*, 139*b* of the contact portions 138, 139 of the pair of signal conductors 13*c*, 13*d* are disposed between the longitudinal edges 149*a*, 149*b* of the contact portion 149 of the different corresponding ground conductor 14.

Figure 11:
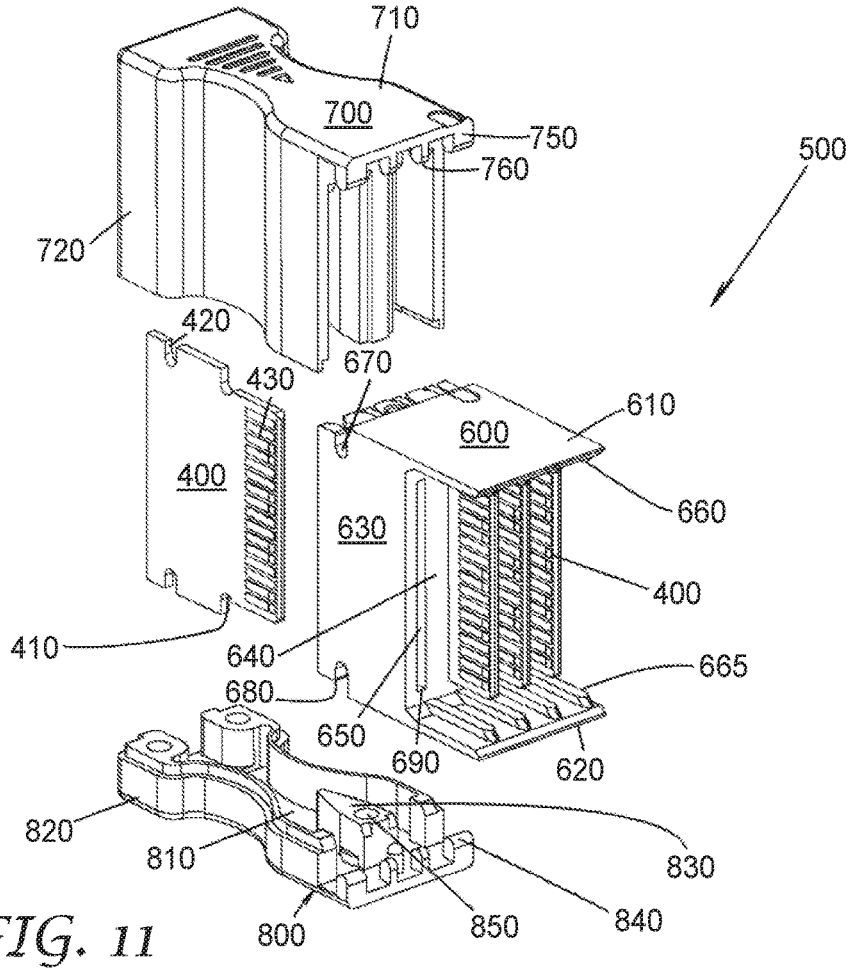
FIG. 11 is a schematic perspective view of a plug connector housing, according to one embodiment of the present invention.
Figure 12:
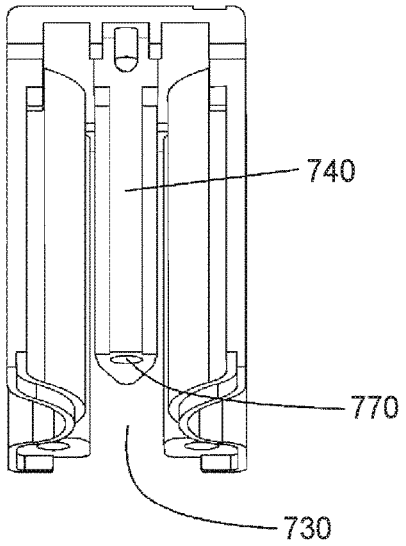
FIG. 12 is a slightly angled front view of the front housing portion of the plug connector housing shown in FIG. 11.

According to an alternative aspect of the present invention, in one embodiment, a plug connector housing 500 is disclosed. As shown in FIGS. 11 and 12, the plug connector housing 500 includes a front housing portion 600, a top housing portion 700, a bottom housing portion 800.

The front housing portion 600 includes: a top wall 610, a bottom wall 620, a pair of opposing side walls 630 extending between the top and bottom walls, and a vertical front mating wall 640. The vertical front mating wall 640 extends between the top, bottom and side walls and defines a plurality of spaced apart vertical slots 650 extending therethrough. Each vertical slot 650 is configured to receive a circuit board 400.

The front housing portion 600 further includes: a top flange 660 coplanar with the top wall and extending forwardly from the mating wall, and a bottom flange 665 coplanar with the bottom wall and extending forwardly from the mating wall. At least one first engaging member 670 (e.g. a notch) is disposed on a top side of one of the side walls behind the top wall. At least one second engaging member 680 (e.g. a notch) is disposed on a bottom side of one of the side walls behind the bottom wall. A third engaging member 690 is disposed on an inside surface of one of the top and bottom walls.

The top housing portion 700 includes: a top wall 710, a pair of opposing side walls 720 extending downwardly from the top wall. The top and side wall defines a cavity 730 for receiving a plurality of circuit boards 400. A first divider 740 extends downwardly from the top wall 710 and is disposed between the sidewalls 720. At least one first engaging member 750 (e.g a bump) is disposed on an inside surface and front of the top wall 710. A second engaging member 760 (e.g a bump) is disposed on an inside surface of the top wall 710. A first position hole 770 is located on a bottom of the divider.

The bottom housing portion 800 includes: a bottom wall 810, a pair of opposing side walls 820 extending upwardly from the bottom wall, and a second divider 830 extending upwardly from the top wall 810 and disposed between the sidewalls 820. The bottom housing portion 800 further includes at least one first engaging member (e.g a bump) 840 on a top side and front of the bottom wall 810, and a first position hole 850 on a top of the divider.

The front, top and bottom housing portions are reversibly assembled such that the at least one first engaging member 670 of the front housing portion engages the at least one first engaging member 750 of the top housing portion, and the at least one second engaging member 680 of the front housing portion engages the at least one first engaging member 840 of the bottom housing portion. A fastener is provided to engage the first position hole 770 of the top housing portion with the first position hole 850 of the bottom housing portion.

The plug connector housing is configured to receive at least one circuit board 400. The circuit board 400 has first 410 and second 420 engaging members along an edge of the circuit board and an edge connector 430 at a front of the circuit board. Each circuit board is disposed within a corresponding vertical slot 650 with the edge connector 430 of the circuit board extending forwardly from the mating wall 640 between the top 660 and bottom 665 flanges. As an example shown in the FIG. 11, the plug connector housing has four vertical slots 650 and configured to receive four circuit boards 400 at the most. Three of such circuit boards 400 have been exemplarily located in the slots 650. When the circuit board 400 is well located, the third engaging member 690 of the front housing portion engages the first engaging member 410 of the circuit board, and the second engaging member 760 of the top housing portion engages the second engaging member 420 of the circuit board.

As an example, the paddle card 30 mentioned above can be selected as the circuit board 400.

Concerning the above, an embodiment of the present invention provides an electrical interconnection system and electrical connectors (i.e., electrical receptacle connector and electrical plug cable assembly) for such electrical interconnection system, which may be used in a high speed and high density electrical communication system. The electrical plug cable assembly according to the present invention may substitute a conventional backpanel printed circuit board that brings signal loss/attenuations in the signal transmission adopted in the conventional electrical communication system. Accordingly, applications of the electrical connector assembly according to aspects of the present invention in high speed and high density electrical communication systems may achieve low signal loss/attenuations and long distance signal transmission, which is suitable for high density electrical communications and signal transmissions. Furthermore, in at least one aspect, the present invention provides an electrical signal transmission system suitable for long distance and high density electrical communications and signal transmissions. In at least one aspect, the present invention may further provide an electrical plug connector housing adopted in the electrical connector in such electrical interconnection system.

In some embodiments as described above, the face to face arrangement of the signal conductor and ground conductor in two wafers and the alternation arrangement of the signal conductor and ground conductor in one wafer can help shield at least part of the electromagnetic interference from adjacent signal conductors, and consequently reduce the EMI and improve the signal transmission quality.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A connector comprising:

first and second wafers, each wafer comprising:

a housing comprising a mating edge configured to face a mating connector and orthogonal to a mounting edge configured to mount onto a board;

a plurality of pairs of signal contacts and a plurality of shielding contacts fixed within the housing and alternately arranged with one another along a transverse direction of the housing, each signal contact and each shielding contact in the pluralities of pairs of signal contacts and shielding contacts comprising:

a contact portion outside and at the mating edge of the housing for contacting a corresponding contact of a mating connector;

a mounting portion outside and at the mounting edge of the housing for contacting a corresponding conductive trace on a board; and a connecting portion disposed within the housing and connecting the contact portion and the mounting portion, the connecting portion having opposing longitudinal edges extending from the mating edge to the mounting edge, the contact portions of each pair of signal contacts in one wafer facing the contact portion of a different corresponding shielding contact in the other wafer and when viewed from a side of the connector, the longitudinal edges of the contact portions of the pair of signal contacts are disposed between the longitudinal edges of the contact portion of the different corresponding shielding contact.

* * * * *